US007559307B2

(12) United States Patent
Inui et al.

(10) Patent No.: US 7,559,307 B2
(45) Date of Patent: Jul. 14, 2009

(54) OIL FILTER MOUNTING STRUCTURE IN INTERNAL COMBUSTION ENGINE

(75) Inventors: Hiroatsu Inui, Saitama (JP); Hiromi Sumi, Saitama (JP); Tomokazu Baba, Saitama (JP); Hideyuki Tawara, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 124 days.

(21) Appl. No.: 11/896,874

(22) Filed: Sep. 6, 2007

(65) Prior Publication Data

US 2008/0060606 A1 Mar. 13, 2008

(30) Foreign Application Priority Data

Sep. 11, 2006 (JP) ..... 2006-246098

(51) Int. Cl.
*F01M 11/03* (2006.01)

(52) U.S. Cl. ..... 123/196 A; 123/195 C

(58) Field of Classification Search ..... 123/196 A, 123/195 A, 195 C
See application file for complete search history.

(56) References Cited

U.S. PATENT DOCUMENTS 7,421,996 B2 * 9/2008 Oki ..... 123/195 C
2007/0175433 A1 * 8/2007 Tomaru ..... 123/196 A
2008/0173274 A1 * 7/2008 Inui et al. ..... 123/196 R

FOREIGN PATENT DOCUMENTS

JP 7-317521 A 12/1995
JP 2008-64080 * 3/2008

* cited by examiner

*Primary Examiner*—Hai H Huynh
(74) *Attorney, Agent, or Firm*—Birch, Stewart, Kolasch & Birch, LLP

(57) ABSTRACT

An oil filter mounting structure in an internal combustion engine in which the outside a crankcase in the direction of a crankshaft is covered by a case cover. A spacer is interposed between the crankcase and the case cover. The spacer is formed with a lubrication system. An oil filter is mounted to an oil filter mounting surface of the spacer which is flush with a mating surface with respect to the crankcase. A part of the crankcase to which the oil filter mounting surface of the spacer faces is formed with a recess opening on top to which the oil filter is mounted. The resulting configuration provides an oil filter mounting structure in which an oil filter is reliably protected from stones. Further, oil channels are shortened to achieve a compact light-weight internal combustion engine.

20 Claims, 13 Drawing Sheets

FIG. 8
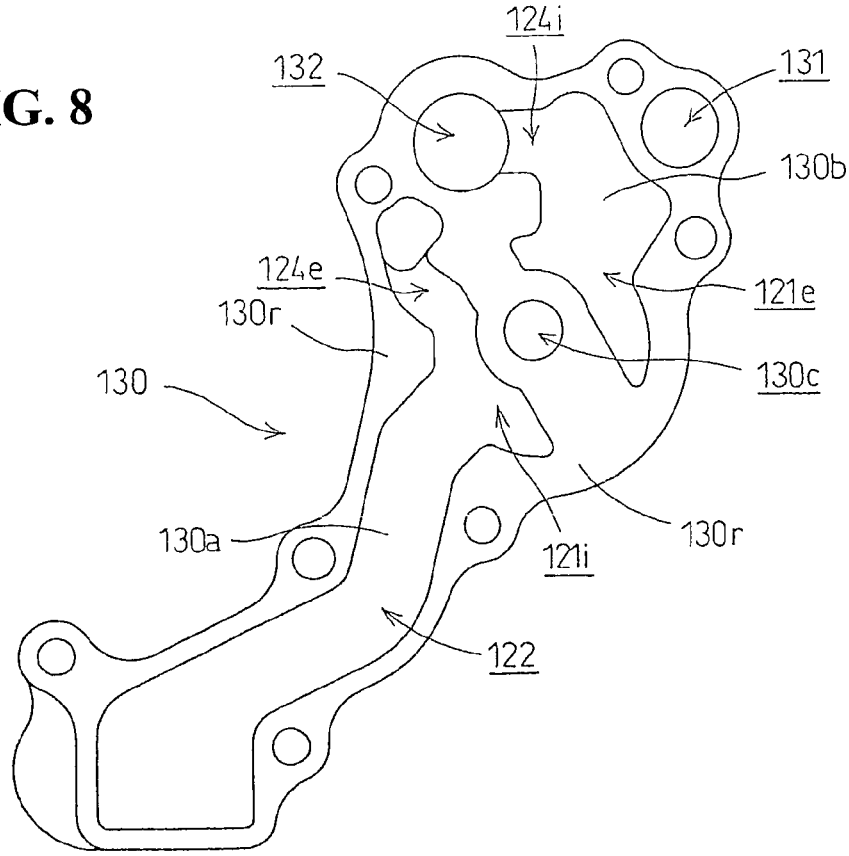
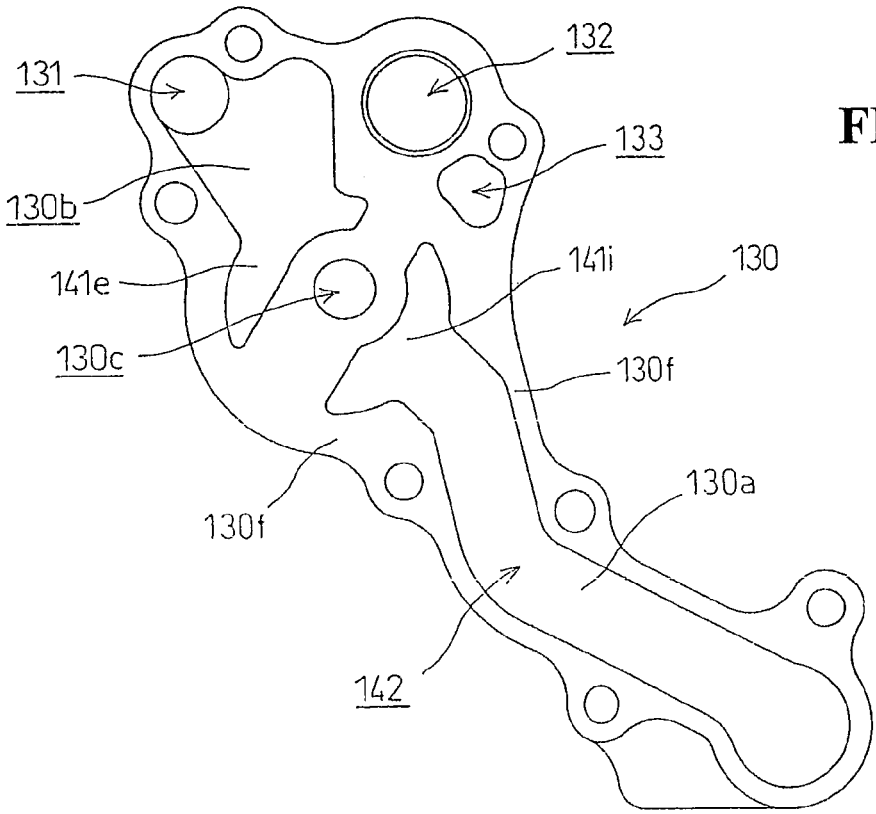
FIG. 9

OIL FILTER MOUNTING STRUCTURE IN INTERNAL COMBUSTION ENGINE

CROSS-REFERENCE TO RELATED APPLICATION

The present application claims priority under 35 U.S.C. §119 to Japanese Patent Application No. 2006-246098, filed Sep. 11, 2006, the entire contents of which are hereby incorporated by reference.

BACKGROUND OF THE INVENTION

1. Field of the Invention

The present invention relates to an oil filter mounting structure in an internal combustion engine.

2. Description of Background Art

A lubrication system in an internal combustion engine is generally configured in such a manner that oil accumulated in an oil pan is pumped by an oil pump, and the oil discharged from the oil pump is supplied to the respective parts to be lubricated in the internal combustion engine.

The oil discharged from the oil pump passes through an oil filter before being supplied to the respective parts to be lubricated so that impurities are eliminated from the oil.

The oil filter is mounted to a crankcase in which oil channels are configured from the outside so as to be demounted easily at the time of maintenance, and is mounted to the crankcase normally so as to protrude therefrom.

Therefore, in a vehicle-mounted internal combustion engine, the oil filter mounted to the crankcase so as to protrude therefrom is subject to disturbance during travel.

Therefore, the oil filter mounting structure disclosed in JP-A-7-317521 is such that a curved recess in the vertical direction is formed on the oil pan, which is to be connected to the lower portion of the crankcase, so as to notch part thereof, and the oil filter is mounted to the lower surface of the crankcase along the curved recess.

However, the oil filter disclosed in JP-A-7-317521 is provided on the lower surface of the crankcase along the curved recess in the vertical direction of the oil pan so as to protrude downward, and the side of the oil filter is partly surrounded by the curved recess in the vertical direction, but the lower side is opened.

Therefore, the oil filter provided in the curved recess is protected from stones coming from the front, but is not protected from stones hitting thereto from below.

Since the oil filter is arranged on the lower surface of the crankcase which is the same level as the oil pan, the lengths of a filter introducing channel of oil from the oil pump which is located at a higher level than the oil filter and a filter deriving channel from the oil filter extending to the respective parts to be lubricated located at a higher level than the oil filter increase, and hence the total amount of oil increases, whereby the crankcase which constitutes the oil channels is upsized and the weight of the internal combustion engine is increased.

In view of such problems, it is an object of the present invention to provide an oil filter mounting structure in which the oil filter is reliably protected from the stones hitting thereto and the lengths of the oil channels are reduced to achieve the compact light-weight internal combustion engine.

SUMMARY AND OBJECTS OF THE INVENTION

In order to achieve the object described above, according to an embodiment of the present invention, an oil filter mounting structure in an internal combustion engine in which the outside a crankcase in the direction of a crankshaft is covered by a case cover. A spacer is interposed between the crankcase and the case cover, the spacer is formed with a lubrication system, an oil filter is mounted to an oil filter mounting surface of the spacer which is flush with a mating surface with respect to the crankcase, and a part of the crankcase to which the oil filter mounting surface of the spacer faces is formed with a recess opening on top to which the oil filter can be mounted.

According to an embodiment of the present invention, the spacer includes an oil pump assembled thereto, a filter introducing channel which communicates a pump discharge port of the oil pump and an oil introducing port on the oil filter mounting surface is defined by opposed channel walls and a bottom wall which is formed at least into a recess in cross section. A filter deriving channel which communicates an oil deriving port and an oil supply port on the oil filter mounting surface is defined by opposed channel walls and a bottom wall which is formed at least into a recess in cross section.

According to an embodiment of the present invention, an opening end surface of the opposed channel walls of the spacer is in flush with a mating surface with respect to the case cover, and a partitioning plate is brought into abutment with the opening end surface of the opposed channel walls to configure the filter introducing channel and the filter deriving channel.

According to an embodiment of the present invention, an oil tank chamber is formed between the side wall of the spacer which is closer to the mating surface with respect to the crankcase and the case cover. The spacer is formed with a pump body of the oil pump in cooperation with the channel walls, and a pump intake channel formed on the pump body has a pump intake port opening at the lower portion of the oil tank chamber.

Advantages of the present invention include the following:

Since the oil filter mounted on the oil filter mounting surface of the spacer interposed between the crankcase and the case cover is arranged in the recess of the crankcase opening on top, the oil filter is reliably protected from stones or the like from below.

Since the spacer is formed with the lubrication system, the filter introducing channel of oil from the oil pump to the oil filter mounted on the spacer and the filter deriving channel extending from the oil filter to the respective parts to be lubricated or the like are shortened, the total amount of the oil may be reduced, and the crankcase itself is downsized, so that the compact light-weight internal combustion engine is achieved.

Since the spacer is assembled with the oil pump and is formed with the filter introducing channel and the filter deriving channel formed at least into a recess in cross section, the oil pump and the oil filter may be arranged intensively on the spacer. Therefore, short oil channels may be formed with a simple configuration, and it is not necessary to form complicated oil channels in the crankcase, whereby the crankcase itself may further be downsized.

Since the partitioning plate is brought into abutment with the opening end surface of the opposed channel walls which is in flush with the mating surface with respect to the case cover to configure the filter introducing channel and the filter deriving channel, the filter introducing channel and the filter deriving channel may be configured easily with a small number of parts. As a result, the weight of the engine and the labor required to assemble the engine can be reduced.

Since the oil tank chamber is formed between the side wall of the spacer which is close to the mating surface with respect to the crankcase and the case cover, the oil tank chamber swells toward the crankcase. Hence, a large capacity of the oil tank chamber may be secured with a simple configuration in which the lubrication system such as the pump body is formed on the spacer.

The pump intake channel formed in the pump body of the spacer has the pump intake port opening at the lower portion of the oil tank chamber, and the pump body and the pump intake port are formed integrally. Thus, the oil pump configuration is simple.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 8 is a rear view of a partitioning plate;

FIG. 9 is a front view of the partitioning plate;

DETAILED DESCRIPTION OF THE PREFERRED EMBODIMENTS

Figure 1:
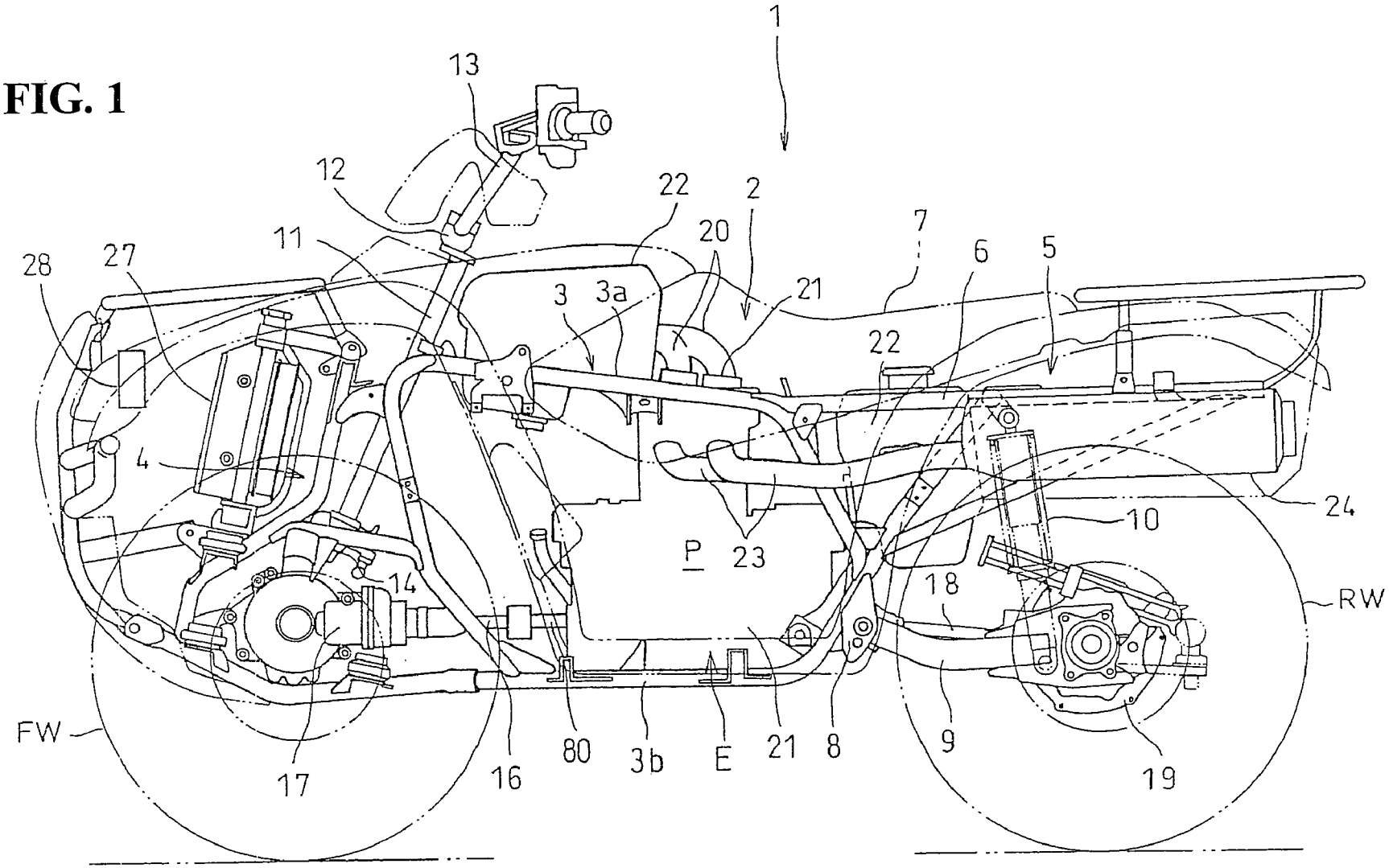
FIG. 1 is a side view of a rough-terrain traveling vehicle in which a power unit according to an embodiment of the present invention is mounted with a vehicle body cover or the like removed.
Figure 2:
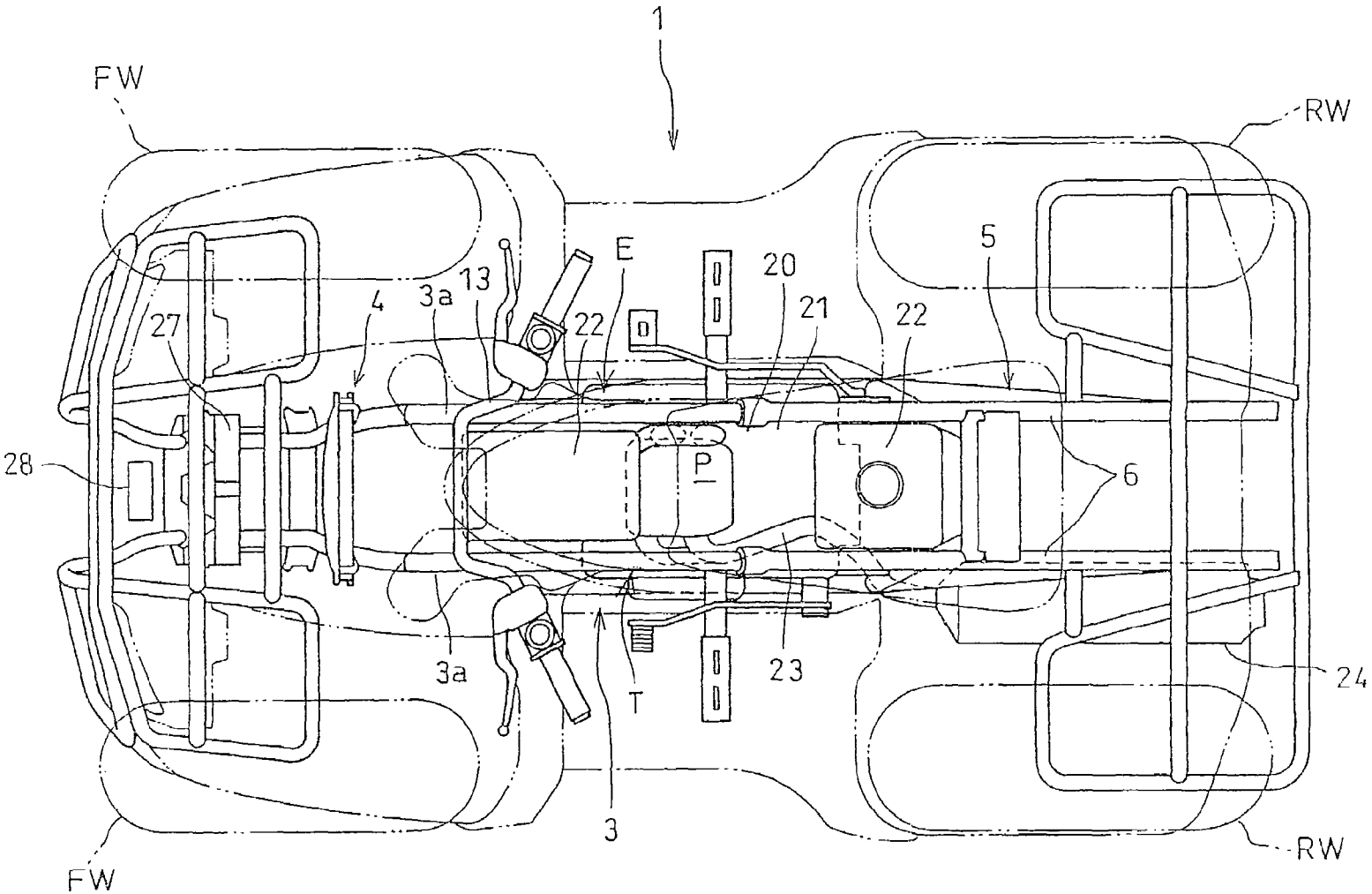
FIG. 2 is a plan view of the same.

A side view of a rough-terrain traveling vehicle 1 in which a water-cooled internal combustion engine E according to this embodiment is mounted with a vehicle body cover or the like removed is shown in FIG. 1, and a plan view of the same is shown in FIG. 2.

In this embodiment, the front, rear, left and right are defined on the basis of a direction viewing in the direction of travel of the vehicle.

The rough-terrain traveling vehicle 1 is a saddle type four-wheel vehicle, and a pair of left and right front wheels FW on which low-pressure balloon tires for rough-terrain are mounted and a pair of left and right rear wheels RW on which the same balloon tires are mounted are suspended in the front and rear of a vehicle body frame 2.

The vehicle body frame 2 is configured with a plurality of types of steel material joined together, and includes a center frame portion 3 in which a power unit P having the internal combustion engine E and a transmission T provided integrally in a crankcase 31, a front frame portion 4 connected to the front portion of the center frame portion 3 for suspending the front wheels FW, and a rear frame portion 5 connected to the rear portion of the center frame portion 3 and having a seat rail 6 for supporting a seat 7.

The center frame portion 3 includes a pair of left and right upper pipes 3*a* and a pair of left and right-lower pipes 3*b*, the upper pipes 3*a* each substantially forming three sides by being bent downward at front and rear thereof, and the lower pipes 3*b* each substantially forming one side to form substantially a rectangular shape in side view, and the left and right pipes are connected by a cross member.

Swing arms 9 whose front ends are supported rotatably via a shaft by pivot plates 8 fixed to portions of the lower pipes 3*b* extending obliquely upward at the rear end thereof, rear cushions 10 are provided between the rear portion of the swing arms 9 and the rear frame portion 5, and the rear wheels RW are suspended by rear final reduction gear units 19 provided at the rear ends of the swing arms 9.

A steering column 11 is supported at the lateral center of the cross member extending between the front end portions of the left and right upper pipes 3*a*, and a steering handle 13 is connected to the upper end portion of a steering shaft 12 steerably supported by the steering column 11, and the lower end portion of the steering shaft 12 is connected to a front wheel steering mechanism 14.

The internal combustion engine E of the power unit P is a water-cooled two-cylinder internal combustion engine and is mounted to the center frame portion 3 with a crankshaft 30 oriented in the fore-and-aft direction of a vehicle body, that is, in a so-called vertical posture.

The transmission T of the power unit P is arranged on the left-hand side of the internal combustion engine E, and an output shaft 80 oriented in the fore-and-aft direction is projecting toward the front and rear from the transmission T at a position which is displaced toward the left, so that a rotational force of the output shaft 80 is transmitted from the front end of the output shaft 80 to the left and right front wheels FW via a front drive shaft 16 and a front final reduction gear unit 17, and is transmitted from the rear end thereof to the left and right rear wheels RW via rear drive shafts 18 and the rear final reduction gear units 19.

A radiator 27 is supported in the front frame portion 4 of the vehicle body frame 2, and an oil cooler 28 is disposed in front thereof.

Figure 3:
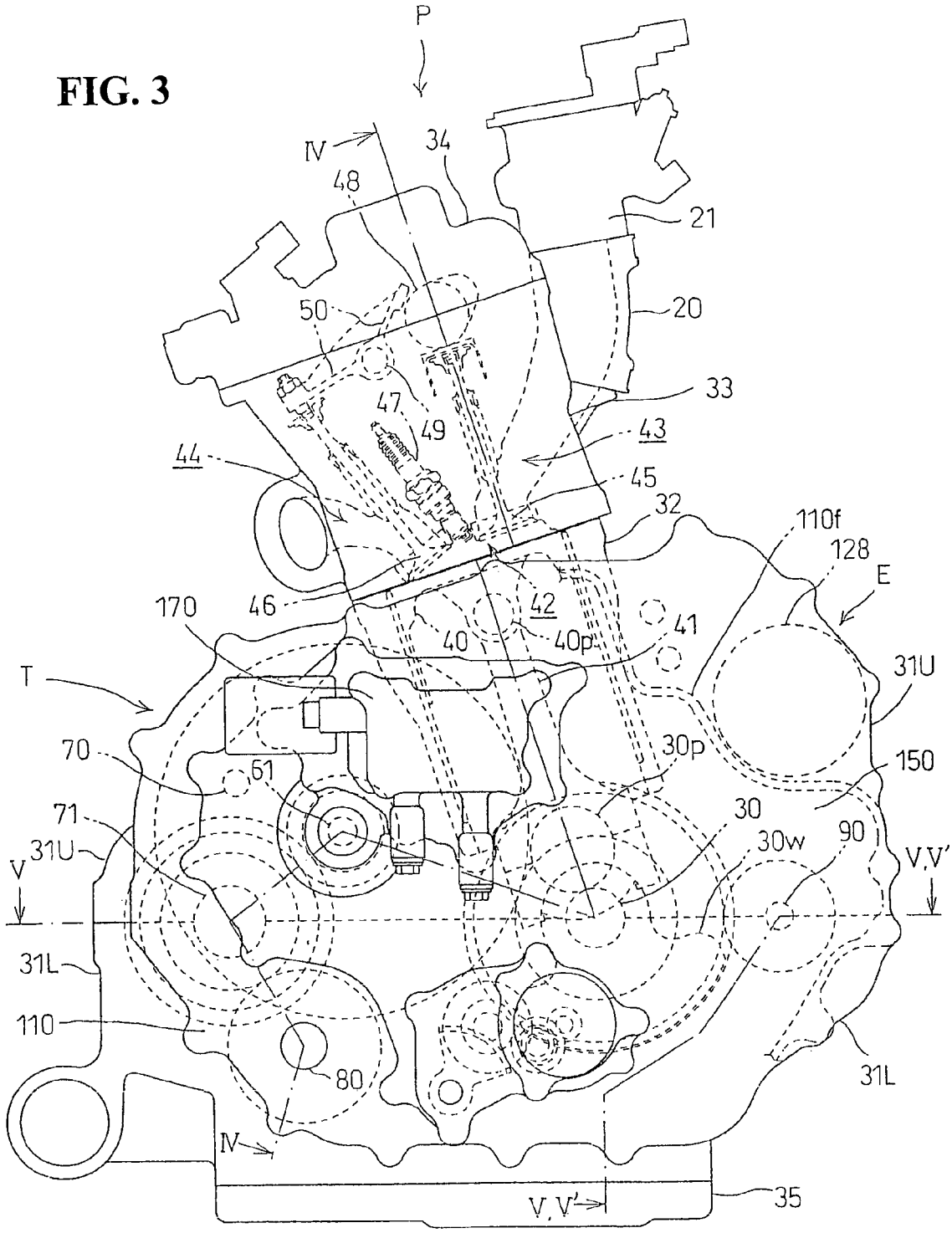
FIG. 3 is a rear view of the power unit.

Referring to FIG. 3 which is a rear view of the power unit P, the crankcase 31 which contains the internal combustion engine E and the transmission T of the power unit P in the interior thereof has a vertically divided structure divided into upper and lower halves, that is, an upper crankcase 31U and a lower crankcase 31L, along a plane including the crankshaft 30.

A cylinder block portion 32 formed integrally with the upper crankcase 31U at the upper portion thereof with two cylinder bores 32*c* arranged in series are formed so as to incline slightly toward the left and extend upward, a cylinder head 33 is placed on the top of the cylinder block portion 32, and the cylinder head 33 is covered with a cylinder head cover 34.

On the other hand, an oil pan 35 is attached to the bottom of the lower crankcase 31L.

Curved air-intake pipes 20 extending substantially upward from a right wall of the cylinder head 33 are connected to an air cleaner 22 arranged above the internal combustion engine E with the intermediary of a throttle body 21, and a curved exhaust pipe 23 extending rearward from a left wall of the cylinder head 33 is connected to an exhaust muffler 24 attached on the left-hand side of the rear frame portion 5.

Figure 4:
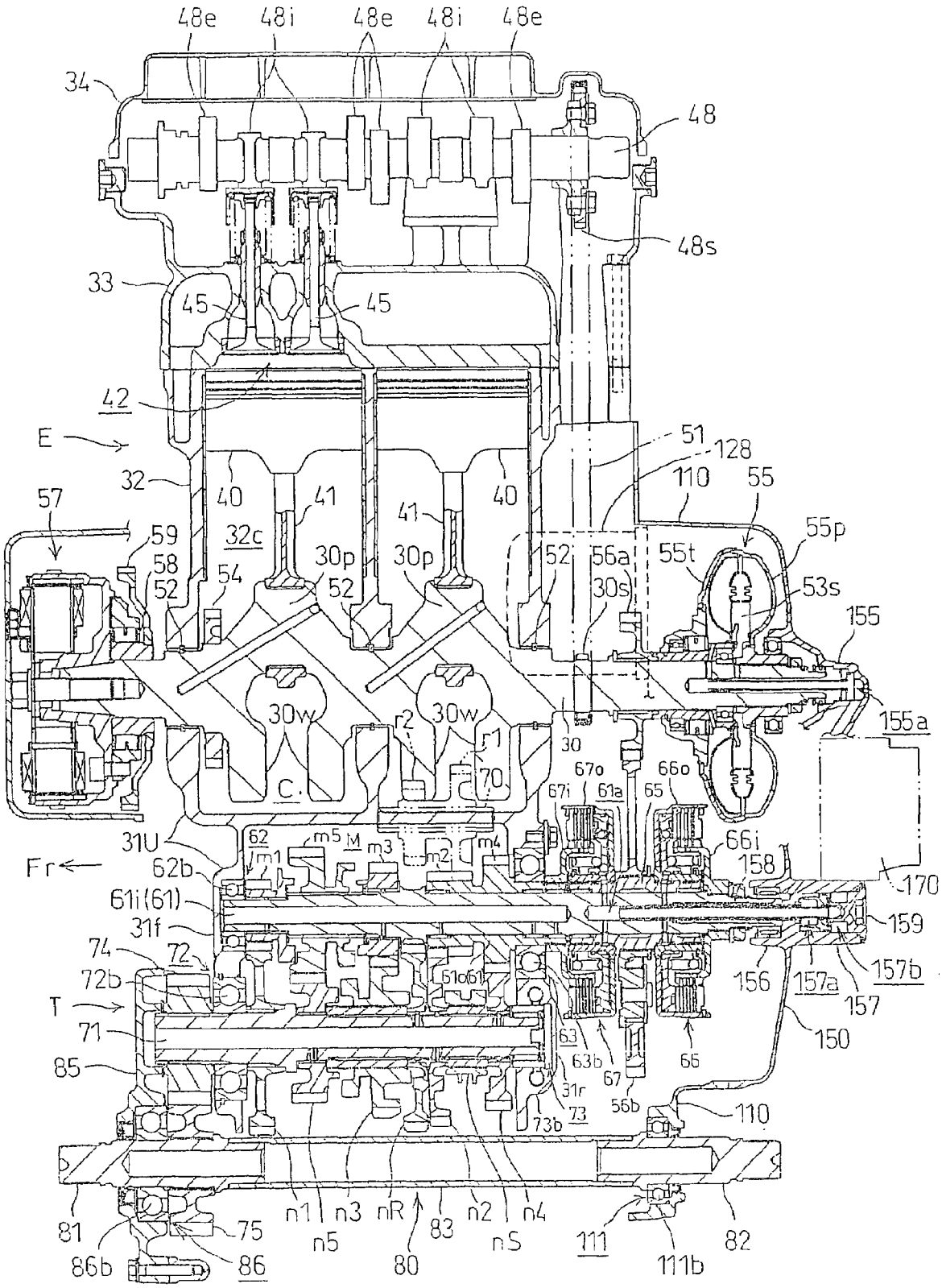
FIG. 4 is a developed cross-sectional view of the power unit (taken along the line IV-IV in FIG. 3)

Referring now to FIG. 3 and FIG. 4, pistons 40 are fitted to the two cylinder bores 32*c* of the cylinder block portion 32 so as to be capable of sliding reciprocation, and crank pins 30*p* between crank webs 30*w*, 30*w* of the crankshaft 30 and piston pins 40*p* of the pistons 40 are connected by connecting rods 41, so that a crank mechanism is configured.

In the cylinder head 33, each cylinder bore 32*c* includes a combustion chamber 42 opposing the pistons 40, an air-intake port 43 opening into the combustion chamber 42 and extending rightward and upward so as to be opened and closed by a pair of air-intake valves 45, exhaust ports 44 extending forward so as to be opened and closed by a pair of exhaust valves 46, and ignition plugs 47 mounted thereto so as to be exposed into the combustion chamber 42.

The air-intake pipes 20 are connected to the air-intake ports 43.

The upper ends of the air-intake valves 45 come into abutment with air-intake cam robs 48*i* of a camshaft 48, which is rotatably supported by the cylinder head 33 via a shaft, one end of a locker arm 50 rotatably supported by a rocker arm shaft 49 via a shaft comes into abutment with exhaust cam robs 48*e* of the camshaft 48, and the upper ends of the exhaust valves 46 come into abutment with the other ends of the rocker arms 50.

Therefore, the air-intake valves 45 and the exhaust valves 46 open and close the air-intake ports 43 and the exhaust ports 44 synchronously with the rotation of the crankshaft 30 by the camshaft 48 at a predetermined timing.

In order to do so, the camshaft 48 is fitted with a cam sprocket 48*s* at the rear portion thereof, and a timing chain 51 is wound between a drive sprocket 30*s* fitted to the portion of the crankshaft 30 near the rear end portion thereof and the cam sprocket 48*s* (see FIG. 4), so that the camshaft 48 is driven to rotate at half a revolving speed of the crankshaft 30.

The crankshaft 30 is rotatably supported by being clamped between the upper crankcase 31U and the lower crankcase 31L via a plane bearing 52 and, as shown in FIG. 4, the rear portion of the crankshaft 30 projected rearward from a crank chamber is formed with the drive sprocket 30*s*, and a primary drive gear 56*a* is provided on further rear ends thereof via a fluid coupling 55 as a fluid joint.

The fluid coupling 55 includes a pump impeller 55*p* fixed to the crankshaft 30, a turbine runner 55*t* opposed thereto, and a stator 53*s*.

The primary drive gear 56*a* is joined with the turbine runner 55*t* which is rotatable with respect to the crankshaft 30, and the power from the crankshaft 30 is transmitted to the primary drive gear 56*a* via hydraulic oil.

The primary drive gear 56*a* meshes with a primary driven gear 56*b* which is rotatably supported by a main shaft 61, described later, and transmits the rotation of the crankshaft 30 to the main shaft 61 side.

On the other hand, a starting driven gear 59 is supported by the front side portion of the crankshaft 30 projecting forward from a crank chamber C via an AC generator 57 and a one way clutch 58.

A balancer shaft drive gear 54 is fitted to a portion of the crankshaft 30 extending along the inner surface of the front wall of the crank chamber C.

A transmission chamber M is defined by being partitioned by a partitioning wall in the left side of the crank chamber C that accommodates the crank webs 30*w* of the crankshaft 30.

A transmission gear mechanism 60 accommodated in the transmission chamber M is a constantly engaging gear mechanism, in which the main shaft 61 is supported by the upper crankcase 31U at a position leftward and obliquely upward of the crankshaft 30, and a counter shaft 71 located in the left side of the crankshaft 30 is supported on a partitioning plane by being sandwiched between the upper and lower crankcases 31U, 31L at a position leftward and obliquely downward of the crankshaft 61 (see FIG. 3).

The main shaft 61 includes an inner cylinder 61*i* and an outer cylinder 61*o* which rotatably fits on part of the inner cylinder 61*i*. The front end of the inner cylinder 61*i* is rotatably supported by a bearing recess 62 formed on a front wall 31*f* of the transmission chamber M of the upper crankcase 31U with the intermediary of a bearing 62*b*, the outer cylinder 61*o* is fitted on the inner cylinder 61*i* substantially at a center position on the rear side so as to be capable of relative rotation, and part of the outer cylinder 61*o* is rotatably supported by a bearing opening 63 formed on a rear wall 31*r* of the transmission chamber M with the intermediary of a bearing 63*b* and is supported together with the inner cylinder 61*i*.

The outer cylinder 61*o* is integrally formed with a second transmission drive gear m2 and a fourth transmission drive gear m4 at the front and back respectively on a portion inside the bearing 63*b* and the outer portion projects partly outward from the bearing 63*b*.

On the inner cylinder 61*i*, a first transmission drive idle gear m1, a fifth transmission drive gear m5 formed integrally with a shifter and spline-fitted to the inner cylinder 61*i* and a third transmission drive idle gear m3 in sequence from the front on the front side of the second and fourth transmission drive gears m2 and m4 on the outer cylinder 61*o* are supported, and the outer portion of the inner cylinder 61*i* projects further rearward from the outer portion of the outer cylinder 61*o*.

The bearing recess 62 formed on the front wall 31*f* is formed to have a small inner diameter for supporting the front end of the inner cylinder 61*i* having a small diameter, while the bearing opening 63 formed on the rear wall 31*r* is formed to have an inner diameter smaller than the fifth transmission drive gear m5 having the largest diameter and larger than the diameter of the fourth transmission drive gear m4, and is used for assembling work of the main shaft 61.

An input sleeve 65 is rotatably fitted on the outer portion of the inner cylinder 61*i* in juxtaposition with the outer cylinder 61*o*, and the primary driven gear 56*b* is fitted at the center of the input sleeve 65, so that the primary driven gear 56*b* meshes with the primary drive gear 56*a* on the side of the crankshaft 30.

A first transmission clutch 66 is assembled to the input sleeve 65 at a position rearwardly of the primary driven gear 56*b*, and a second transmission clutch 67 is assembled thereto at a position forwardly of the primary driven gear 56*b*.

A pair of the first transmission clutch 66 and the second transmission clutch 67 are hydraulic multiple disc friction clutches having the same structure.

The first transmission clutch 66 includes a cup-shaped clutch outer 66*o* opening rearward integrally fitted to the input sleeve 65, and a clutch inner 66*i* integrally fitted to the internal cylinder 61*i*.

On the other hand, the second transmission clutch 67 includes a cup-shaped clutch outer 67*o* opening forward integrally fitted to the input sleeve 65 and a clutch inner 67*i* integrally fitted to the outer portion of the outer cylinder 61*o*.

When hydraulic pressure is supplied to the first transmission clutch 66 and hence the clutch outer 66*o* and the clutch inner 66*i* are connected, the rotation of the input sleeve 65 which is integral with the primary driven gear 56*b* is transmitted to the rotation of the second and fourth transmission drive gears m2, m4 of the outer cylinder 61*o*, and when hydraulic pressure is not supplied, the clutch outer 66*o* and the clutch inner 66*i* are disconnected and the rotation is not transmitted to the second and fourth transmission drive gears m2 and m4 of the outer cylinder 61*o*.

In the same manner, when the hydraulic pressure is supplied to the second transmission clutch 67 and hence the clutch outer 67*o* and the clutch inner 67*i* are connected, the rotation of the input sleeve 65 which is integral with the primary driven gear 56*b* is transmitted to the inner cylinder 61*i*, and hence the fifth transmission drive gear m5 spline-fitted to the inner cylinder 61*i* is rotated, and when the hydraulic pressure is not supplied, the clutch outer 67*o* and the clutch inner 67*i* are disconnected and hence the rotation is not transmitted to the fifth transmission drive gear m5 on the inner cylinder 61*i*.

The counter shaft 71 supported on a partitioning plane by being sandwiched between the upper and lower crankcases 31U, 31L at a position leftward and obliquely downward of the main shaft 61 as described above is rotatably supported at the front portion by a bearing opening 72 formed on the front wall 31*f* of the transmission chamber M via a bearing 72*b*, and is rotatably supported at the rear end thereof by a bearing recess 73 formed on the rear wall 31*r* of the transmission chamber M via a bearing 73*b*.

A first transmission driven gear n1, a fifth transmission driven idle gear n5, a third transmission driven gear n3 formed integrally with the shifter and spline-fitted to the counter shaft 71, a reverse idle gear nR, a second transmission driven idle gear n2, a shifter nS, a fourth transmission driven idle gear n4 are arranged and supported rotatably by the counter shaft 71 via a shaft in sequence from the front in the transmission chamber M.

The first, second and fourth transmission driven gears n1, n2, and n4 constantly mesh with the first, second and fourth transmission drive gears m1, m2 and m4 on the main shaft 61.

The third transmission drive idle gear m3 and the third transmission driven gear n3, and the fifth transmission drive gear m5 and the fifth transmission driven idle gear n5 may be meshed by shifting the shifter.

A reverse idle shaft 70 is disposed at a position above the counter shaft 71 (see FIG. 3 and FIG. 4), a reverse large diameter gear r1 and a reverse small diameter gear r2 are supported by the reverse idle shaft 70 so as to rotate integrally, the reverse large diameter gear r1 meshes with the second transmission drive gear m2 on the main shaft 61, and the reverse small diameter gear r2 meshes with the reverse gear nR on the counter shaft 71.

The fifth transmission drive gear m5 on the main shaft 61 and the third transmission driven gear n3 on the counter shaft 71 are shifter gears, and shifting of the respective transmission speeds is performed in association with control of the first transmission clutch 66 and the second transmission clutch 67 by the two shifter gears and the shifter nS on the counter shaft 71 being shifted in the axial direction by a transmission drive mechanism.

The front end of the counter shaft 71 projects forwardly from the bearing 72*b*, and an output gear 74 is spline-fitted to the front end.

The output shaft 80 is disposed downwardly and obliquely rightward of the counter shaft 71 (see FIG. 3), and a driven gear 75 spline-fitted to the front portion of the output shaft 80 meshes with the output gear 74 at the front end of the counter shaft 71, so that a power is transmitted from the counter shaft 71 to the output shaft 80.

Since a larger load by the meshing between the output gear 74 and the driven gear 75 of the output shaft 80 is applied to the output gear 74 at the front end of the counter shaft 71, the bearing 72*b* for rotatably supporting the front portion of the counter shaft 71, which is employed here, is relatively large.

Therefore, the inner diameter of the bearing opening 72 for fitting the bearing 72*b* of the front wall 31*f* is also large. However, since the bearing recess 62 of the adjacent main shaft 61 is small as descried before, the strength of the front wall 31*f* of the crankcase 31 around the output gear 74 may be maintained at a high level.

A front case cover 85 is covered the upper and lower crankcases 31U, 31L configured to be divided into upper and lower halves so as to extend across the partitioning plane on the front surface from which the counter shaft 71 and the output shaft 80 project, and a rear case cover 150 is covered on the upper and lower crankcase 31U, 31L so as to extend across the partitioning plane on the rear surface of the crankcase 31L and cover the fluid coupling 55 at the rear end of the crankshaft 30 and the first and second transmission clutches 66 and 67 at the rear ends of the main shaft 61 via a spacer 110 which also serves partly as a case cover.

The output shaft 80 is configured with a front end borne portion 81 and a rear end borne portion 82 which are formed by casting and connected by a hollow cylindrical member 83. The front end borne portion 81 is rotatably supported by a bearing opening 86 formed on the front case cover 85 via a bearing 86*b* with the front end projecting forward, and the rear end borne portion 82 is rotatably supported by a bearing opening 111 formed on the spacer 110 via a bearing 111*b* with the rear end projecting rearward.

In other words, the output shaft 80 is rotatably supported by the front case cover 85 and the spacer 110 with the front end borne portion 81 and the rear end borne portion 82 projecting from the front and rear respectively.

The driven gear 75 is spline-fitted to the front end borne portion 81 adjacently inside a bearing 85*b*.

Therefore, the output gear 74 at the front end of the counter shaft 71 meshes the driven gear 75 spline-fitted to the front end borne portion 81 of the output shaft 80, so that a power is transmitted from the counter shaft 71 to the output shaft 80.

Since the output shaft 80 is configured with the front end borne portion 81 and the rear end borne portion 82 which are formed by casting and connected by the hollow cylindrical member 83, the weight of the output shaft 80 may be reduced, and a casting apparatus may be downsized in comparison with the case of casting and molding the entire output shaft as in the related art.

On the other hand, a balancer shaft 90 is rotatably supported by being sandwiched on the partitioning plane between the upper and lower crankcases 31U and 31L at a position rightwardly of the crankshaft 30 (see FIG. 3).

Figure 5:
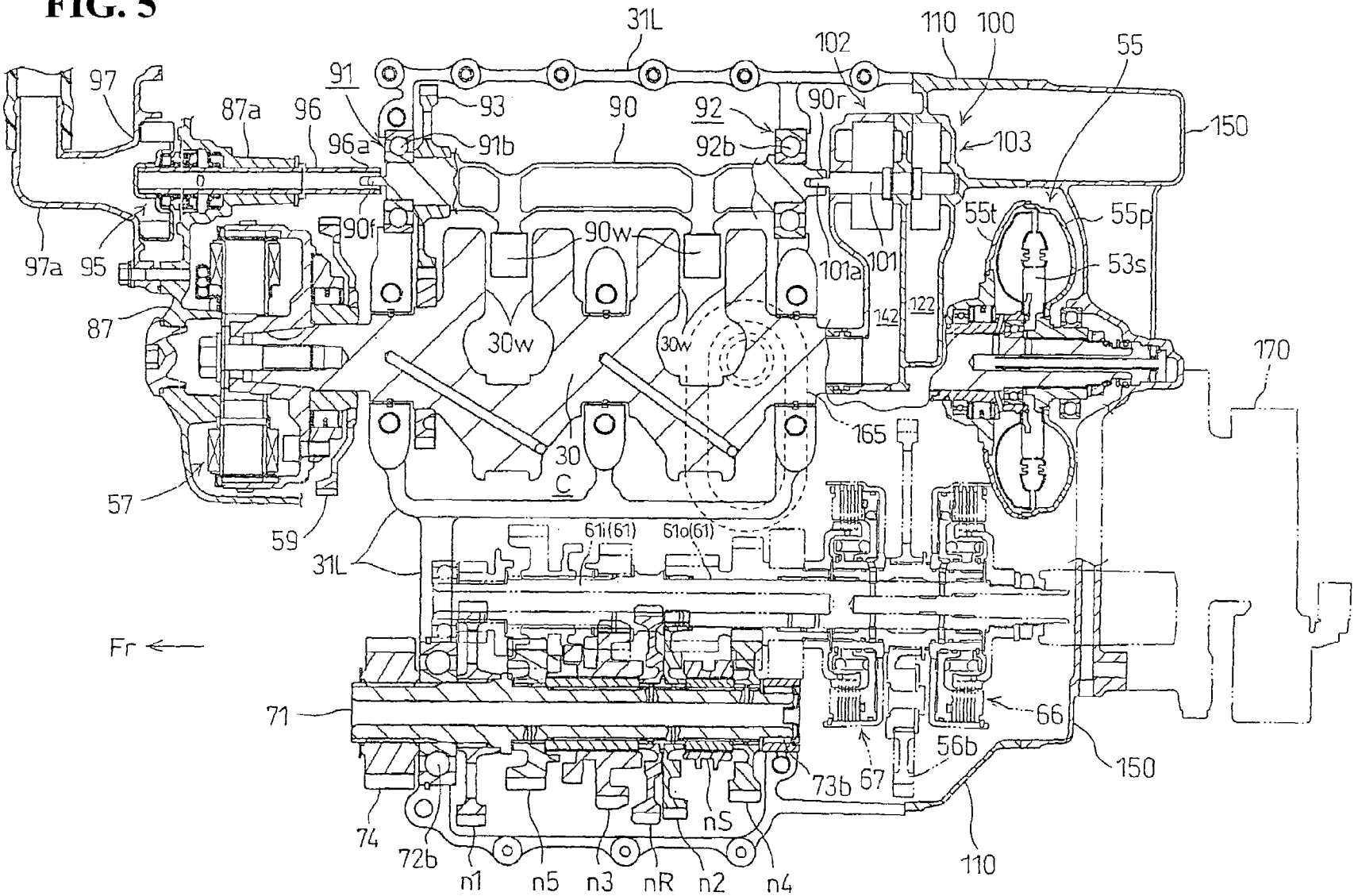
FIG. 5 is a cross-sectional view of the power unit (taken along the lines V-V and V'-V' in FIG. 3)

Referring now to FIG. 5, the balancer shaft 90 is rotatably supported at the front end and the rear end thereof by bearing openings 91 and 92 formed on the front wall and the rear wall of the upper and lower crankcases 31U and 31L via bearings 91*b* and 92*b* respectively.

The balancer shaft 90 is arranged at a position as close as possible to the crankshaft 30 and, as shown in FIG. 5, a balancer weights 90W of the balancer shaft 90 is overlapped with (counter weights of) crank webs 30*w* of the crankshaft 30 in the direction of the crankshaft (fore-and-aft direction).

A driven gear 93 is spline-fitted to the bearing 91*b* fitted at the front end of the balancer shaft 90 adjacently inside the bearing 91*b*, and the driven gear 93 meshes with the balancer shaft drive gear 54 fitted to the crankshaft 30 so that the rotation of the crankshaft 30 is transmitted to the balancer shaft 90 at the same revolving speed.

Therefore, primary vibrations caused by the reciprocal motion of the pistons 40 are cancelled by the rotation at the same speed as the crankshaft 30 of the balancer shaft 90.

A water pump 95 provided on a front cover member 87 for covering the AC generator 57 or the like from the front is provided forwardly of the balancer shaft 90, and a water pump drive shaft 96 rotatably supported by a bearing cylinder 87*a* of the front cover member 87 is arranged coaxially with the balancer shaft 90.

A connecting projection 90*f* projecting forward from the front end of the balancer shaft 90 and a connecting recess 96*a* formed at the rear end of the water pump drive shaft 96 are fitted so that the rotation of the balancer shaft 90 is transmitted to the water pump drive shaft 96 to drive the water pump 95.

The front side of the water pump 95 is covered with a water pump cover 97 provided with an intake cylinder 97*a*.

The intake cylinder 97*a* of the water pump cover 97 is connected by the radiator 27 and a water piping arranged on the front side of the vehicle body, so that the water pump 95 sucks cooling water from the radiator 27.

On the other hand, an oil pump unit 100 provided on the spacer 110 is disposed rearwardly of the balancer shaft 90, an oil pump drive shaft 101 rotatably supported by the oil pump unit 100 is arranged coaxially with the balancer shaft 90.

A connecting recess 90*r* formed at the rear end of the balancer shaft 90, and a connecting projection 101*a* projecting at the front end of the oil pump drive shaft 101 are fitted, so that the rotation of the balancer shaft 90 is transmitted to the oil pump drive shaft 101 to drive the oil pump unit 100.

A dry sump system is employed for lubrication of this power unit P, and both rotors of a scavenge pump 102 and a feed pump 103 are mounted to the oil pump drive shaft 101 of the oil pump unit 100.

As described above, since the water pump drive shaft 96 is coaxially connected to the front end of the balancer shaft 90 and the oil pump drive shaft 101 is coaxially connected to the rear end thereof, the three shafts are connected coaxially, and hence the number of the revolving shafts arranged in parallel to the crankshaft 30 apart from each other may be reduced, and a complicated power transmission mechanism is not necessary between the revolving shafts, so that the internal combustion engine may be downsized.

Since the balancer shaft 90 is arranged at a position where the crank webs 30*w* of the crankshaft 30 and the balancer weights 90W are overlapped in the axial direction, the internal combustion engine E is further downsized by an extent corresponding to the proximity of the balancer shaft 90 with respect to the crankshaft 30.

The water pump 95 arranged forwardly of the balancer shaft 90 is provided on the front surface of the crankcase 31, and is provided at a position close to the radiator 27 arranged forwardly of the vehicle body, whereby the water piping for connecting the radiator 27 and the water pump 95 may be shortened.

Therefore, the weight of the vehicle body may be reduced by reducing the total amount of water.

The oil pump unit 100 arranged rearwardly of the balancer shaft 90 is arranged rearwardly of the power unit P, and hence oil exhaustion or air interfusion due to deviation of oil toward the rear when climbing a slope may easily be prevented.

A lubrication system of this power unit P including the oil pump unit 100 is positioned intensively rearwardly of the crankcase 31. The dry sump lubrication structure system will be described below.

A spacer 110 interposed between the upper and lower crankcases 31U and 31L and the rear case cover 150 is provided with the oil pump unit 100 of the dry sump lubrication system and is formed with part of an oil tank chamber 160.

Figure 6:
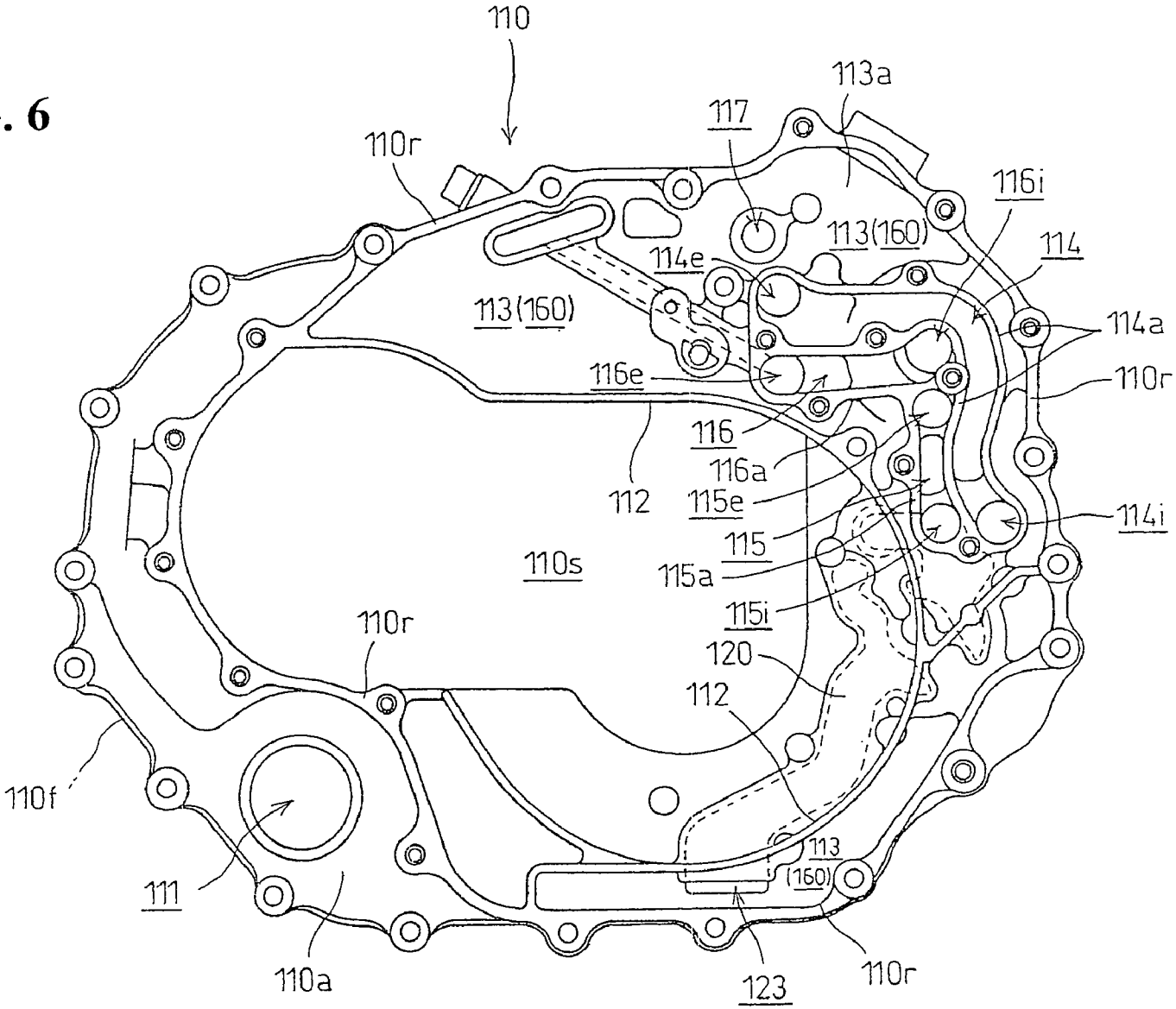
FIG. 6 is a rear view of a spacer.
Figure 7:
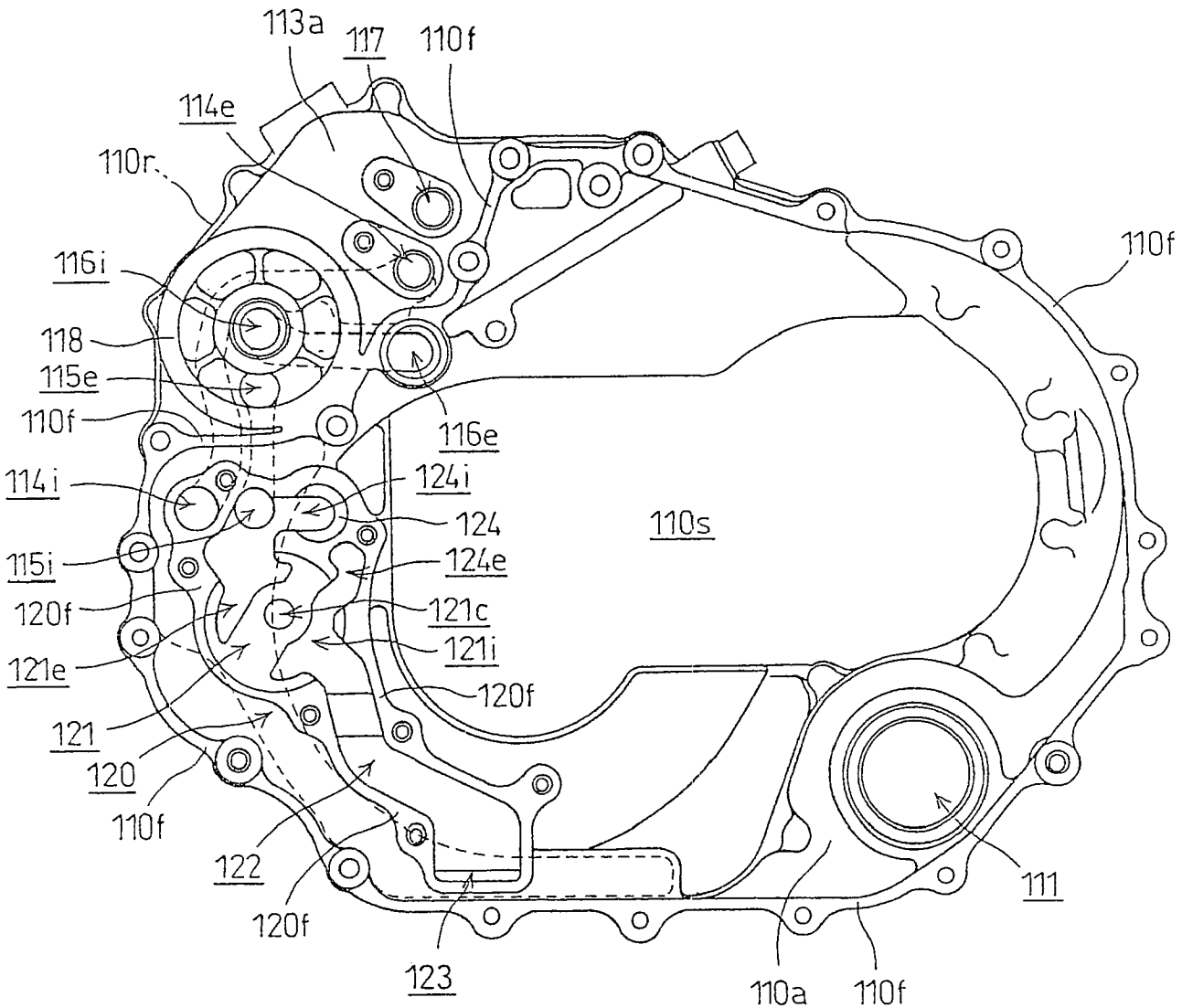
FIG. 7 is a front view of the spacer.

FIG. 6 is a rear view of the spacer 110 and FIG. 7 is a front view of the spacer 110.

Referring to FIG. 6 and FIG. 7, the spacer 110 is for connecting the upper and lower crankcases 31U and 31L and the rear case cover 150, and includes annular mating surfaces 110*f* and 110*r* oriented in parallel to each other in the front and rear.

The front mating surface 110*f* to be mated with the upper and lower crankcases 31U and 31L and the rear mating surface 110*r* to be mated with the rear case cover 150 are extending in parallel to each other and defines a closed annular shape.

The annular front mating surface 110*f* and the rear mating surface 110*r* are shifted from each other in the fore-and-aft direction. The lower left portion of the front mating surface 110*f* protrudes outwardly of the rear mating surface 110*r* from the left side, and the upper right portion of the rear mating surface 110*r* protrudes outward from the front mating surface 110*f*.

A bearing opening 111 for passing the output shaft 80 therethrough is formed on a side wall 110*a* which connects both surfaces of the front mating surface 110*f* protruding to the lower left side from the rear mating surface 110*r*.

Referring now to FIG. 6, the inner side of the closed annular rear mating surface 110*r* is such that an inner wall 112 extends rightward from the upper left portion of the rear mating surface 110*r*, curves downward while drawing an arc, extends leftward along the bottom of the rear mating surface 110*r*, continues to the lower portion of the rear mating surface 110*r*, and forms a large void 110*s* at a center portion thereof in cooperation with part of the rear mating surface 110*r*.

The rear end surface of the inner wall 112 and the rear mating surface 110*r* define the identical plane.

Formed between the curbed portion which covers the outside of the arcuate portion of the inner wall 112 of the rear mating surface 110*r* and the inner wall 112 is a recess (receding part) 113, which is recessed toward the front, and the recess 113 defines an oil tank chamber 160 and is formed into an arcuate shape so as to surround the arcuate portion of the inner wall 112.

The right upper portion of the recess (receding part) 113 is formed with an oil discharge channel 114 defined by channel walls 114*a* and 114*a* projecting from a bottom wall 113*a* of the recess 113 opposing to each other, and forms a recess in cross section in cooperation at least with the bottom wall 113*a*. The oil discharge channel 114 is bent into an L-shape, and the end portion thereof is closed by connecting the channel walls 114*a* and 114*a* opposed to each other.

A channel wall 115*a* projects so as to oppose the vertical portion of the channel wall 114*a* of the L-shaped oil discharge channel 114 on the left side, so that a filter introducing channel 115 forming a recess in cross section in cooperation at least with the bottom wall 113*a* is formed on the left-hand side of the vertical portion of the discharged oil channel 114.

The upper and lower ends of the filter introducing channel 115 are closed by connecting the opposed channel walls 114*a* and 115*a*.

A channel wall 116*a* projects so as to oppose the horizontal portion of the channel wall 114*a* of the L-shaped oil discharge channel 114 on the lower side, so that a filter deriving channel 116 forming a recess in cross section in cooperation at least with the bottom wall 113*a* is formed below the horizontal portion of the discharged oil channel 114.

The left and right end portions of the filter deriving channel 116 are closed by connecting the opposed channel walls 114*a* and 116*a*.

The respective rear end surfaces of the channel walls 114*a*, 115*a* and 116*a* are continued in flush with each other, and are also in flush with the rear mating surface 110*r* and the rear end surface of the inner wall 112.

Figure 11:
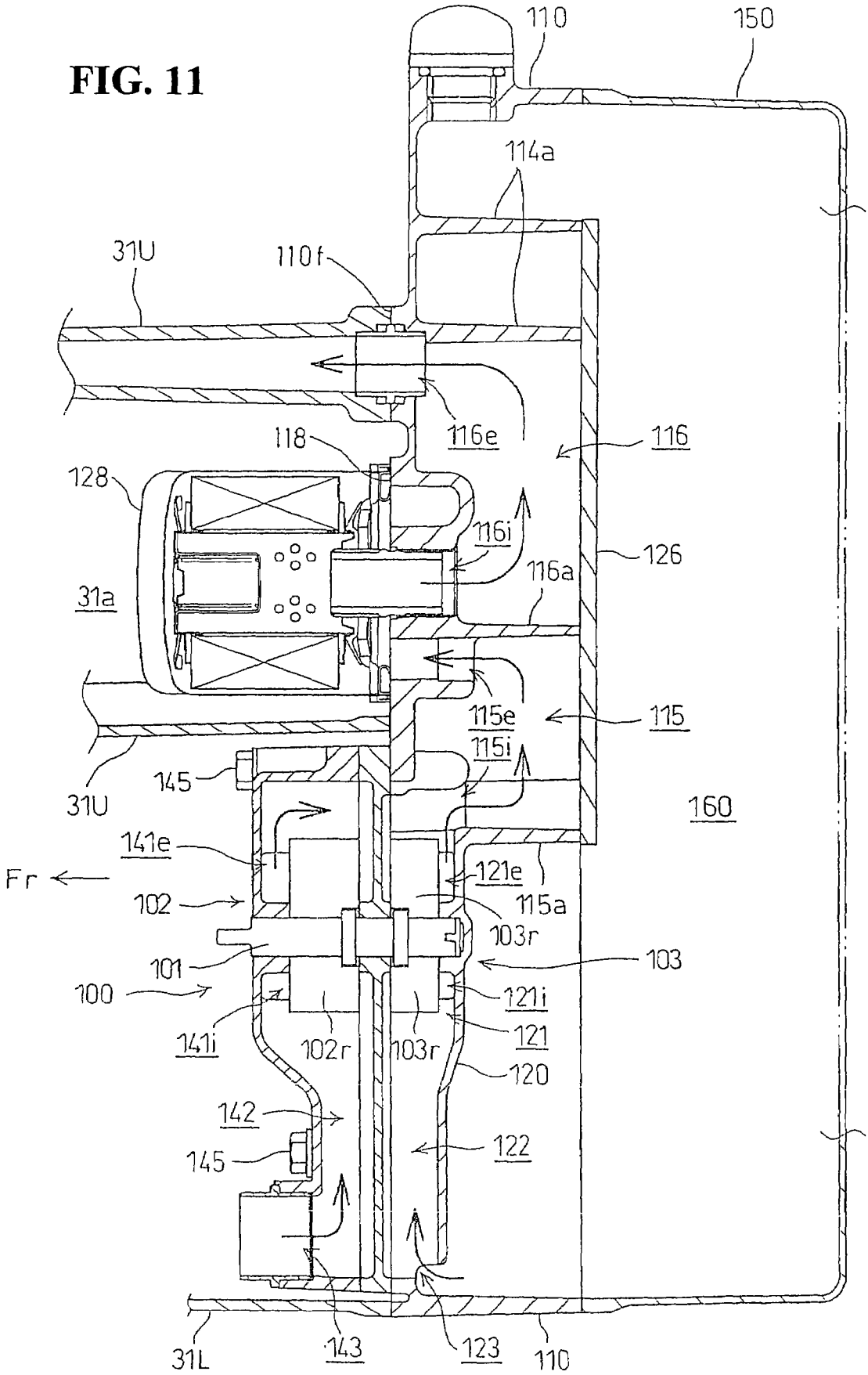
FIG. 11 is a developed cross-sectional view of an oil pump unit and the periphery thereof (taken along the line XI-XI in FIG. 14)

An L-shaped aluminum partitioning plate 126 comes into abutment with the rear end surfaces of the continuing channel walls 114*a*, 115*a* and 116*a*, which are in flush with each other, to close the rear openings of the oil discharge channel 114, the filter introducing channel 115, and the filter deriving channel 116 formed into the recess in cross section, so that the oil discharge channel 114, the filter introducing channel 115 and the filter deriving channel 116 are formed into tubular channels (see FIG. 11).

Therefore, the spacer 110 is configured in such a manner that the oil discharge channel 114, the filter introducing channel 115, and the filter deriving channel 116 are at least formed to have the recess in cross section, and hence it is not necessary to form the complicated oil channel in the crankcase 31, whereby the crankcase 31 itself may further be downsized.

The oil discharge channel 114, the filter introducing channel 115, the filter deriving channel 116 may be formed easily with a small number of components only by mounting the partitioning plate 126, so that the weight reduction of the power unit P and the reduction of the labor of the assembling work are achieved.

The L-shaped oil discharge channel 114 communicates a scavenge pump discharge port 114*i* formed on the bottom wall 113*a* at the lower right end thereof with a discharged oil deriving port 114*e* formed on the bottom wall 113*a* at the upper left end thereof.

The vertically extending filter introducing channel 115 communicates a feed pump discharge port 115*i* formed on the bottom wall 113*a* at the lower end thereof with a filter introducing channel exit 115*e* formed on the bottom wall 113*a* at the upper end thereof.

The horizontally extending filter deriving channel 116 communicates a filter deriving channel inlet port 116*i* formed on the bottom wall 113*a* at the right end thereof with an oil supply port 116*e* formed on the bottom wall 113*a* at the left end thereof.

The oil discharge channel 114, the filter introducing channel 115 and the filter deriving channel 116 surrounded by the channel walls 114*a*, 115*a* and 116*a* are formed into an L-shape so as to project from the bottom wall 113*a* in the recess 113 formed into an arcuate shape, and a portion of the interior of the recess 113 other than the channel walls 114*a*, 115*a* and 116*a* constitutes the oil tank chamber 160.

A discharged oil returning port 117 is formed on a position of the bottom wall 113*a* above the discharged oil deriving port 114*e* at the upper left end of the oil discharge channel 114 with the intermediary of the channel wall 114*a* and opens into the recess 113.

An oil filter mounting surface 118 of a circular shape for mounting an oil filter 128 is formed on the front surface of a portion of the bottom wall 113*a* of the recess 113 corresponding to a bent portion of the L-shaped oil discharge channel 114, the filter introducing channel 115 and the filter deriving channel 116 as shown in FIG. 7.

The oil filter mounting surface 118 is located at a portion recessed inward at the upper right (upper left in FIG. 7) of the annular front mating surface 110*f* protruding outward and is flush with the front mating surface 110*f*.

The oil filter mounting surface 118 is formed of concentric double circles, and the inside of an inner circle corresponds to the filter deriving channel inlet port (oil deriving port) 116*i* and the filter introducing channel exit (oil introducing port) 115*e* is positioned between the inner circle and an outer circle.

The oil filter 128 is mounted from the front to the oil filter mounting surface 118, so that oil entering from the filter introducing channel exit 115*e* is filtered and goes out through the filter deriving channel inlet port 116*i* as shown in FIG. 11.

Although the upper and lower crankcases 31U and 31L are mated with the annular front mating surface 110*f*, the upper crankcase 31U is formed with a recess 31*a* which is recessed inward and opened on top so as to be notched corresponding to the upper right portion of the front mating surface 110*f*, which is recessed to avoid the oil filter mounting surface 118 (see FIG. 7 and FIG. 11), and hence the oil filter 128 mounted to the oil filter mounting surface 118 formed to be exposed to the recess 31*a* is arranged in the recess 31*a*.

Therefore, the oil filter is covered by the recess 31*a* of the upper crankcase 31U from the lower side to the right side so as to be protected reliably from stones or the like hitting thereto from below.

The lubrication system such as the oil pump unit 100 is configured in the spacer 110, and the oil filter 128 is attached to the spacer 110. Therefore, the lengths of the filter introducing channel 115, the filter deriving channel 116 and so on may be shortened, and hence the total amount of oil is reduced, and the crankcase 31 itself is downsized, so that downsizing and weight reduction of the power unit P are achieved.

The discharged oil deriving port 114*e* and the discharged oil returning port 117 positioned on the upper left side of the oil filter mounting surface 118 are positioned also on the annular front mating surface 110*f* protruding outward as in the case of the oil filter mounting surface 118, and is opened outward.

A pipe (not shown) connected respectively to the discharged oil deriving port 114*e* and the discharged oil returning port 117 is connected to the oil cooler 28 arranged in the front of the vehicle body.

The oil pump unit 100 includes a feed pump body 120 of the feed pump 103 formed at the lower right of the spacer 110 with the bottom wall 113*a* recessed rearward at a position below the portion around the lower side of the L-shaped oil discharge channel 114 and the filter introducing channel 115, and is protruded inward of the inner wall 112.

Referring now to FIG. 7, the feed pump body 120 is recessed rearward at an inner portion surrounded by a mating surface 120*f* which is in flush with the front mating surface 110*f*, and is formed at an upper portion with a circular recess 121 to which an internal external rotor 103*r* of the feed pump 103 is fitted is formed, with a feed pump intake channel 122 having a recess in cross section extending obliquely downward from an intake port 121*i* of the circular recess 121, and with a feed pump intake port 123 opening toward the recess 113 (the oil tank chamber 160 side) at the lower end of the feed pump intake channel 122.

The feed pump intake port 123 is a through-hole formed on the spacer 110 and positioned at the lowermost portion of the recess 113.

The feed pump intake channel 122 formed on the feed pump body 120 of the spacer 110 has the feed pump intake port 123 opened at the lower portion of the oil tank chamber 160, and the feed pump body 120 and the feed pump intake port 123 are formed integrally so that the feed pump 103 is formed into a simple configuration.

A bearing recess 121*c* for rotatably supporting the rear end of the oil pump drive shaft 101 is formed at a position deviated from the center of the circular recess 121, and the intake port

121*i* and a discharge port 121*e* are formed so as to be recessed on the somewhat obliquely left and right sides.

The intake port 121*i* communicates with the feed pump intake channel 122 and has a relief return channel 124*e* extending upward.

The discharge port 121*e* extends upward and communicates with the feed pump discharge port 115*i*, and a relief channel 124*i* extends to a relief valve mounting surface 124 to which a relief valve 125 on the left side (the right side in FIG. 7) is mounted.

The scavenge pump discharge port 114*i* opens at the upper right corner of the mating surface 120*f* of the feed pump body 120.

A partitioning plate 130 is placed on the mating surface 120*f* of the feed pump body 120, and the scavenge pump body 140 is placed on the partitioning plate 130, so that the oil pump unit 100 is configured.

In other words, a scavenge pump body 140 and the feed pump body 120 partition the interior of the oil pump unit 100 into the scavenge pump 102 side and the feed pump 103 side with the intermediary of the partitioning plate 130 therebetween.

A rear view of the partitioning plate 130 is shown in FIG. 8 and a front view thereof is shown in FIG. 9.

The partitioning plate 130 includes a rear mating surface 130*r* corresponding to the mating surface 120*f* of the feed pump body 120 and a front mating surface 130*f* corresponding to a mating surface 140*r* of a scavenge pump body 140 formed into an annular shape, which is substantially the same shape, and extend in parallel to each other, so that recesses are formed back to back on the front side and the rear side by being partitioned by partition walls 130*a* and 130*b* inside the rear mating surface 130*r* and the front mating surface 130*f*.

Referring now to FIG. 8, the rear surface of the partitioning plate 130 is formed with a recess which constitutes the feed pump intake channel 122, the intake port 121*i* and the relief return channel 124*e* in cooperation with the feed pump body 120 with the partition wall 130*a* as a bottom surface inside the mating surface 130*r* which corresponds to the mating surface 120*f* of the feed pump body 120, and with a recess which constitutes the discharge port 121*e* and the relief channel 124*i* with the partition wall 130*b* as a bottom surface.

The partitioning plate 130 is formed with a bearing circle hole 130*c* and a scavenge pump discharge hole 131 corresponding respectively with the bearing recess 121*c* of the feed pump body 120 and the scavenge pump discharge port 114*i*, and is formed with a relief valve fitting hole 132 to which the relief valve 125 of a cylindrical shape corresponding to the relief valve mounting surface 124 is fitted.

Referring now to FIG. 9, the front surface of the partitioning plate 130 is formed with a recess which constitutes a scavenge pump intake channel 142 and an intake port 141*i* back to back with the feed pump intake channel 122 and the intake port 121*i* by being partitioned by the partition wall 130*a*, and with a discharge port 141*e* back to back with the discharge port 121*e* by being partitioned by the partition wall 130*b*.

The recess having the front surface of the partition wall 130*b* of the partitioning plate 130 as a bottom surface has the scavenge pump discharge hole 131 opened thereon, and the discharge port 141*e* extends upward to communicate with the scavenge pump discharge hole 131.

A relief return hole 133 is formed below the relief valve fitting hole 132 in proximity to thereto and communicates with the relief return channel 124*e* on the rear surface side.

Figure 10:
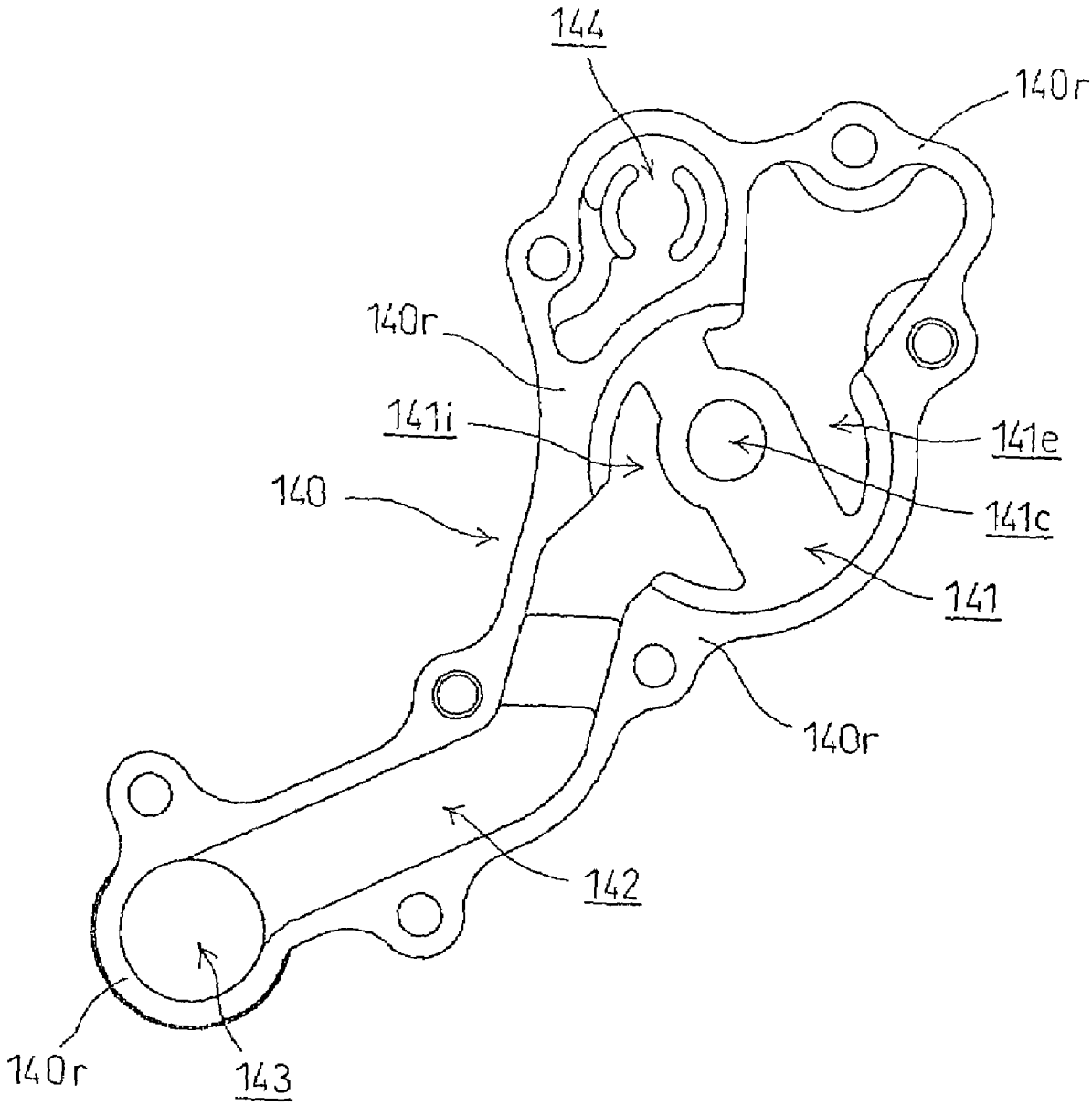
FIG. 10 is a rear (back) view of a scavenge pump body.

As shown as a rear (back) view in FIG. 10, the scavenge pump body 140 to be mated with the front mating surface 130*f* of the partitioning plate 130 is formed with a circular recess 141 for accommodating an internal external rotor 102*r* of the scavenge pump 102 on the inside of the annular mating surface 140*r* corresponding to the front mating surface 130*f* of the partitioning plate 130, and with the scavenge pump intake channel 142 and the intake port 141*i* by the recess formed corresponding to the partition wall 130*a* of the partitioning plate 130 in cooperation with the partitioning plate 130, and a recess formed corresponding to the partition wall 130*b* of the partitioning plate 130 constitutes the discharge port 141*e* in cooperation with the partitioning plate 130.

A bearing recess 141*c* for rotatably supporting the front end of the oil pump drive shaft 101 is formed at a position deviated from the center of the circular recess 141 of the scavenge pump body 140, and a scavenge pump intake port 143 is opened toward the front at the lower end of the scavenge pump intake channel 142.

The discharge port 141*e* of the scavenge pump body 140 extends upward and communicates with the scavenge pump discharge hole 131 of the partitioning plate 130.

The mating surface 140*r* above the circular recess 141 of the scavenge pump body 140 is formed with a fitting recess 144 for fitting the relief valve 125, and part of the fitting recess 144 extends downward to communicate with the relief return hole 133 of the partitioning plate 130.

The oil pump unit 100 is configured by assembling the feed pump body 120 of the spacer 110, the partitioning plate 130 and the scavenge pump body 140.

Figure 12:
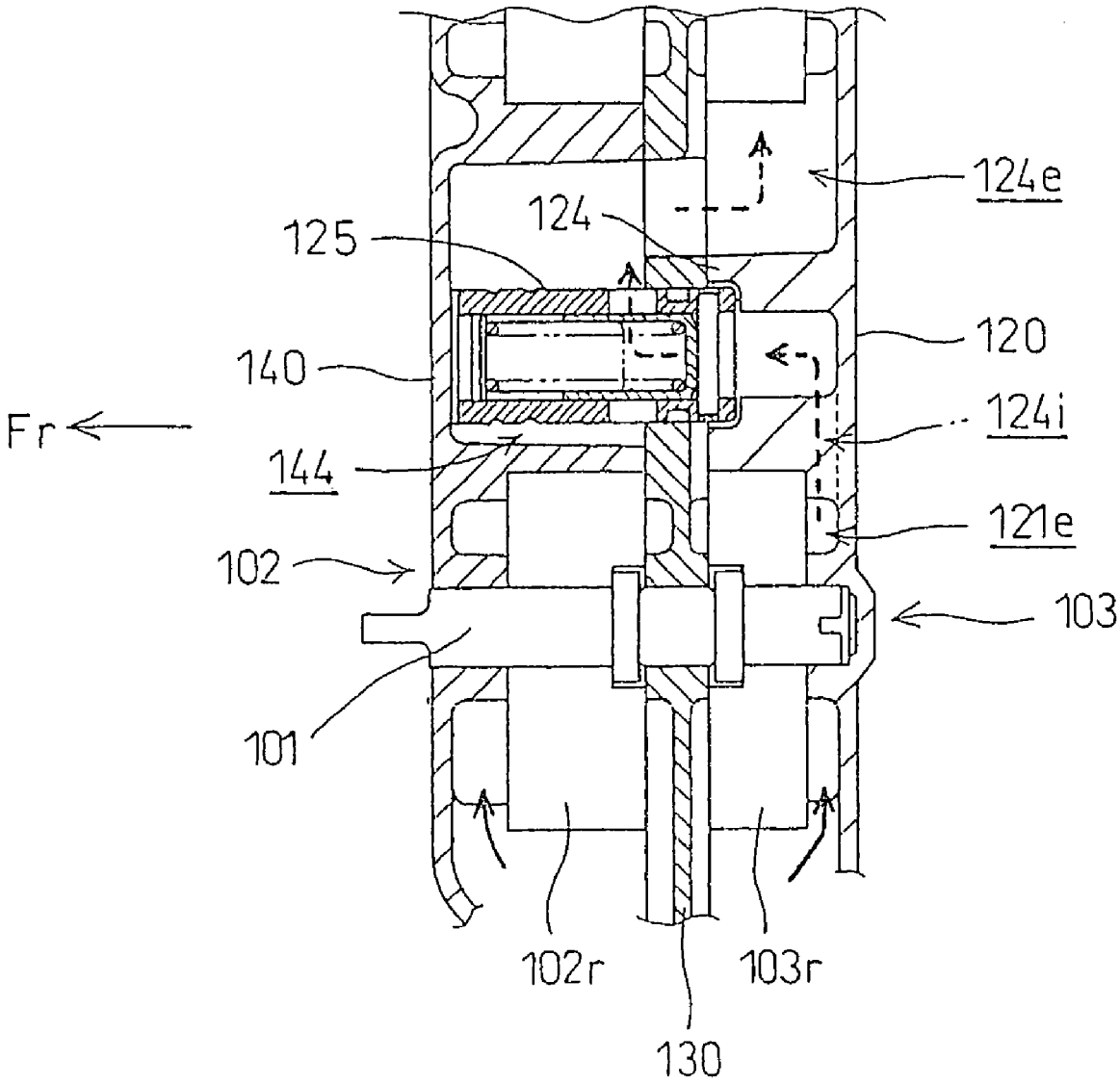
FIG. 12 is a partially developed cross-sectional view of the oil pump unit.

A cross section of the oil pump unit 100 and the lubrication system therearound are shown in FIG. 11, and a partial developed cross section of the oil pump unit 100 is shown in FIG. 12.

The partitioning plate 130 is placed on the mating surface 120*f* of the feed pump body 120 together with the oil pump drive shaft 101 with the intermediary of the rotor 103*r* of the feed pump 103 with respect to the circular recess 121 of the feed pump body 120 of the spacer 110, the rotor 102*r* of the scavenge pump 102 is interposed between the partitioning plate 130 and the circular recess 141 of the scavenge pump body 140, the scavenge pump body 140 is placed on the front mating surface 130*f* of the partitioning plate 130 with the intermediary of the relief valve 125 between the relief valve mounting surface 124 of the feed pump body 120 and the fitting recess 144 of the scavenge pump body 140 via the relief valve fitting hole 132 of the partitioning plate 130, and the partitioning plate 130 and the scavenge pump body 140 are secured integrally with the feed pump body 120 formed on the spacer 110 with a bolt 145 to configure the oil pump unit 100.

The oil filter 128 is mounted to the oil filter mounting surface 118 of the spacer 110 from the outside using the recess 31*a* of the upper crankcase 31U.

The rear case cover 150 is covered on the rear surface of the spacer 110.

Figure 13:
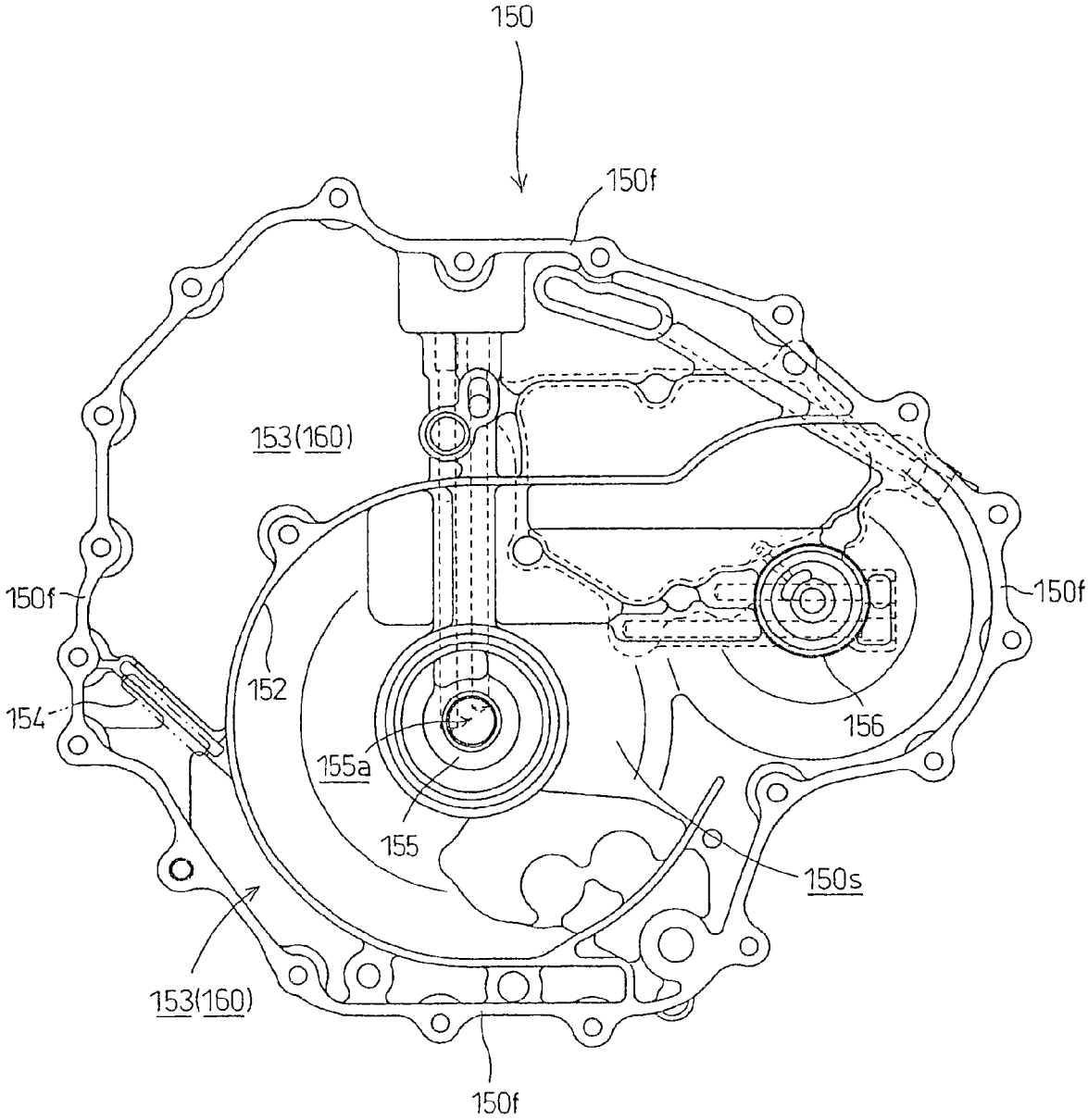
FIG. 13 is a front (rear) view of a rear case cover.

A front (rear) view of the rear case cover 150 is shown in FIG. 13.

The rear case cover 150 includes a mating surface 150*f* corresponding to the rear mating surface 110*r* of the spacer 110, and is formed with an inner wall 152 corresponding to the inner wall 112 of the spacer 110, a recess 153 which is recessed rearward corresponding to the recess 113 formed into an arcuate shape on the spacer 110 located outside the inner wall 152, so that when the rear case cover 150 is superimposed with the spacer 110, the recess 113 and the recess 153 are joined to configure the oil tank chamber 160.

In other words, since the oil tank chamber 160 is formed between the bottom wall (side wall) 113*a* of the spacer 110, which is rather close to the mating surface 110*f* with respect to the upper and lower crankcases 31U and 31L, and the rear case cover 150, the oil tank chamber 160 is swelled toward the crankcase 31, and a large capacity of the oil tank chamber 160 is secured with a simple configuration in which the lubrication system such as the feed pump body 120 is formed on the spacer 110.

The oil discharge channel 114, the filter introducing channel 115, the filter deriving channel 116 and the feed pump body 120 of the spacer 110 are swelled into the oil tank chamber 160. However, since it is only partially, the lost capacity in the oil tank chamber 160 thereby is not much.

The oil tank chamber 160 includes a strainer 154 on the right side thereof so as to partition the interior into the upper and lower parts.

A recess 150*s* inside the inner wall 152 corresponds to a void 110*s* of the spacer 110 for covering the fluid coupling 55 provided at the rear end of the crankshaft 30 and the first transmission clutch 66 and the second transmission clutch 67 provided at the rear end of the main shaft 61 from behind.

A bearing bottomed cylindrical portion 155 is formed at a portion of the recess 150*s* of the rear case cover 150 opposing the crankshaft 30, so that the bearing bottomed cylindrical portion 155 rotatably supports the rear end of the crankshaft 30, and an oil chamber 155*a* is formed for relaying the hydraulic pressure for supplying the hydraulic pressure to the fluid coupling 55 via an oil channel 30*a* in the crankshaft 30 (see FIG. 4 and FIG. 13).

A bearing cylindrical portion 156 is formed at a portion of the recess 150*s* of the rear case cover 150 opposing the main shaft 61, so that the rear end of the inner cylinder 61*i* of the main shaft 61 is supported.

Furthermore, referring now to FIG. 4 and FIG. 13, the bearing cylindrical portion 156 is formed with an outer cylindrical portion 157 so as to extend outward, a double conduction pipe 158 inserted into a shaft hole 61*a* formed from the rear end of the inner cylinder 61*i* to the position of the second transmission clutch 67 is inserted into the outer cylindrical portion 157, so that two oil chambers 157*a*, 157*b* formed in the interior of the outer cylindrical portion 157 by being closed by a lid member 159 which covers the rear end opening thereof are able to supply the hydraulic pressure by communicating with the first transmission clutch 66 and the second transmission clutch 67 respectively via the double conduction pipe 158.

A hydraulic control valve unit 170 is provided at a position obliquely upwardly of the outer cylindrical portion 157 on the rear surface of the rear case cover 150.

Drive control of the first transmission clutch 66 and the second transmission clutch 67 by the hydraulic pressure is preformed, and drive control of the fluid coupling 55 is also performed by the hydraulic control valve unit 170.

Figure 14:
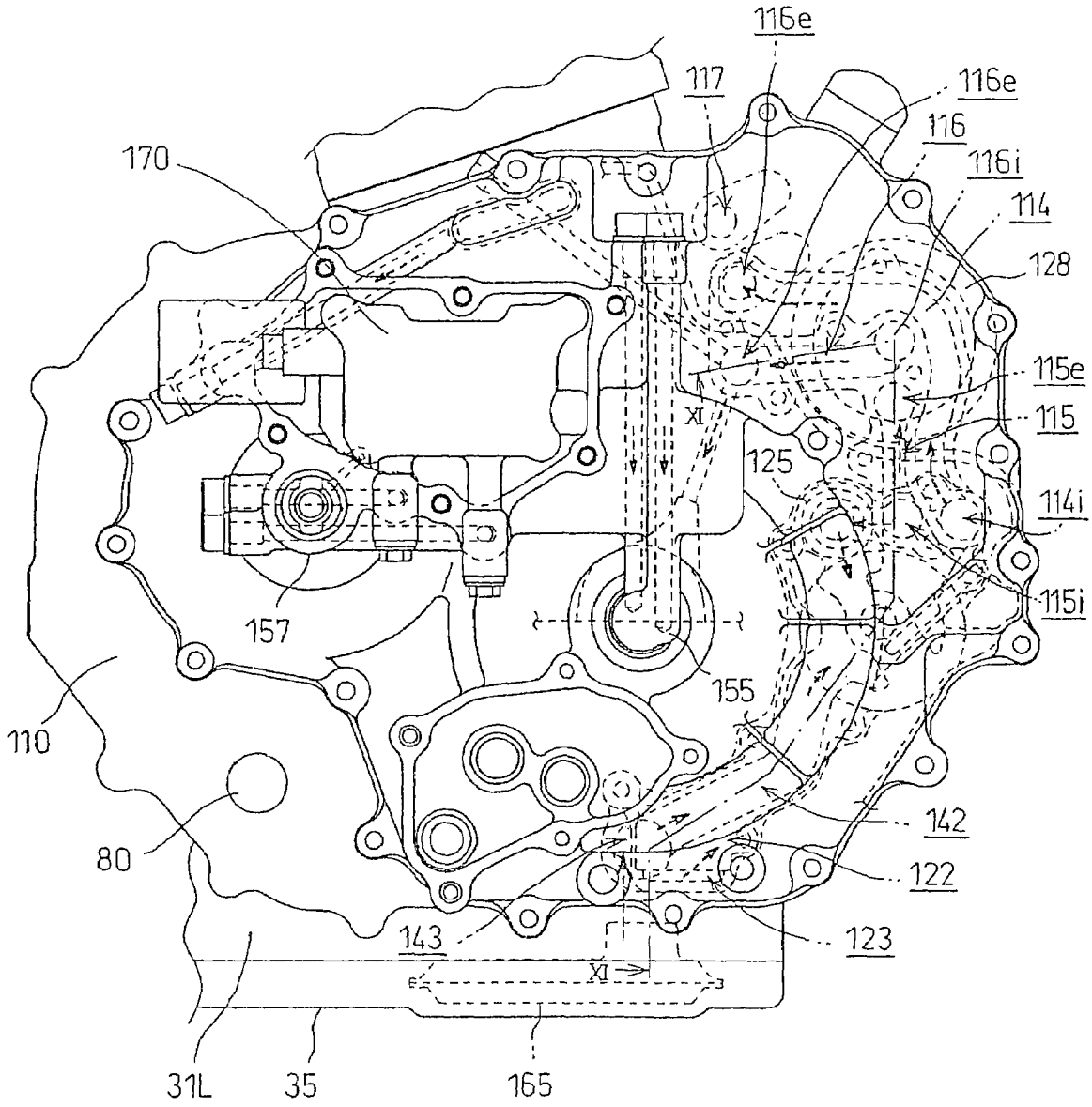
FIG. 14 is a rear view showing a principal portion of a lubrication system of the power unit.

A state of the lubrication system of the power unit P in a state in which the rear case cover 150 is placed on the spacer 110 is shown in FIG. 14.

The oil pump unit 100 and the lubrication system therearound are disposed intensively on the spacer 110 and the rear case cover 150 at the rear of the power unit P.

As shown in FIG. 14, an oil strainer 165 provided in the proximity of the bottom surface of the oil pan 35 is positioned below the crankshaft 30 and rearwardly of the crank chamber C as shown by a broken line in FIG. 5, and is connected by a communication pipe (not shown) substantially under the scavenge pump intake port 143 at the lower end of the scavenge pump intake channel 142.

A flow of oil in this dry sump lubrication system will be described.

When the oil pump drive shaft 101 is rotated, and the rotor 102*r* of the scavenge pump 102 is driven to rotate, oil accumulated in the oil pan 35 is taken into the oil strainer 165 at the rear position thereof, flowed from the scavenge pump intake port 143 through the scavenge pump intake channel 142 to the intake port 141*i* of the scavenge pump 102 (see FIG. 11), and oil discharged from the discharge port 141*e* of the scavenge pump 102 flows from the scavenge pump discharge port 114*i* through an L-shaped oil discharge channel 114 and flows out from the discharged oil deriving port 114*e* to the outer pipe and reaches an oil cooler 28 arranged in front of the vehicle body, and the oil cooled in the oil cooler 28 flows through the outer pipe, and then flows from the discharged oil returning port 117 opening at the upper portion of the oil tank chamber 160 into the oil tank chamber 160 (see FIG. 6 and FIG. 14).

In this manner, the oil flowed into and accumulated in the oil tank chamber 160 is pumped from the feed pump intake port 123 opening at the lower portion of the oil tank chamber 160 by the rotation of a rotor 103*a* of the feed pump 103 and reaches the intake port 121*i* of the feed pump 103 through the feed pump intake channel 122. The oil discharged from the discharge port 121*e* of the feed pump 103 passes from the feed pump discharge port 115*i* through the filter introducing channel 115, and reaches the oil filter 128 from the filter introducing channel exit 115*e*. The oil filtered through the oil filter 128 flows out from the filter deriving channel inlet port 116*i* into the filter deriving channel 116 and is supplied from the oil supply port 116*e* to the respective lubricating points (see FIG. 6, FIG. 11, FIG. 14).

When the discharged hydraulic pressure by the feed pump 103 is increased to a predetermined pressure or higher, the relief valve 125 is opened to communicate the relief channel 124*i* which communicates with the discharge port 121*e* of the feed pump 103 and the relief return channel 124*e* which communicates with the intake port 121*i*, so that the discharged oil is returned to the feed pump intake channel 122.

Therefore, the oil returned into the feed pump intake channel 122 is sucked by the feed pump 103 again, and hence the amount of oil taken from the feed pump intake port 123 is reduced, and hence the flow-in speed is reduced, so that the air interfusion of the feed pump 103 is also reduced.

The oil tank chamber 160 may be downsized to some extent.

As described above, the oil pump unit 100 and the oil filter 128 may be arranged intensively on the spacer 110 located rearwardly of the crankcase 31, and the oil strainer 165 is arranged at the rear of the oil pan 35, so that the oil channels are formed intensively rearwardly of the crankcase 31. Therefore, the lengths of the oil channel may be shortened, so that the total amount of oil is reduced, and hence the weight reduction of the vehicle body is achieved, and the oil exhaustion upon hill-climbing or the air interfusion in the scavenge pump 102 or the feed pump 103 may be prevented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An oil filter mounting structure in an internal combustion engine in which the outside a crankcase in the direction of a crankshaft is covered by a case cover, comprising:

a spacer interposed between the crankcase and the case cover, the spacer being formed with a lubrication system, the spacer being provided with an oil filter mounting surface which is flush with a first mating surface with respect to the crankcase, and a part of the crankcase to which the oil filter mounting surface of the spacer faces is formed with a recess opening on top, wherein the oil filter is mounted on the oil filter mounting surface and extends into the recess of the crankcase.

2. The oil filter mounting structure in an internal combustion engine according to claim 1, wherein the spacer includes:

an oil pump assembled thereto, a filter introducing channel which communicates with a pump discharge port of the oil pump and an oil introducing port on the oil filter mounting surface and is defined by opposed channel walls and a bottom wall which is formed at least into a receding part in cross section, and a filter deriving channel which communicates with an oil deriving port and an oil supply port on the oil filter mounting surface and is defined by opposed channel walls and a bottom wall which is formed at least into the receding part in cross section.

3. The oil filter mounting structure in an internal combustion engine according to claim 2, wherein an opening end surface of the opposed channel walls of the spacer is flush with a second mating surface with respect to the case cover, and a partitioning plate is brought into abutment with the opening end surface of the opposed channel walls to form the filter introducing channel and the filter deriving channel.

4. The oil filter mounting structure in an internal combustion engine according to claim 3, wherein an oil tank chamber is formed between the side wall of the spacer which is closer to the first mating surface with respect to the crankcase and the case cover, the spacer is formed with a pump body of the oil pump in cooperation with the channel walls, and a pump intake channel formed on the pump body has a pump intake port opening at the lower portion of the oil tank chamber.

5. The oil filter mounting structure in an internal combustion engine according to claim 3, wherein the partitioning plate is L-shaped and is formed of aluminum.

6. The oil filter mounting structure in an internal combustion engine according to claim 3, wherein the oil pump includes a scavenger pump body and a feed pump body which are disposed on opposite sides of a pump unit partitioning plate.

7. The oil filter mounting structure in an internal combustion engine according to claim 6, wherein the pump unit partitioning plate is flush with the first mating surface of the spacer.

8. The oil filter mounting structure in an internal combustion engine according to claim 2, the filter introducing channel and the filter deriving channel are L-shaped.

9. The oil filter mounting structure in an internal combustion engine according to claim 1, further comprising an oil pump provided on the spacer, wherein an oil pump drive shaft of the oil pump is arranged coaxially with a balancer shaft.

10. The oil filter mounting structure in an internal combustion engine according to claim 1, wherein the recess in which the oil filter is disposed is formed in an upper portion of the crankcase.

11. An oil filter mounting structure in an internal combustion engine in which the outside a crankcase in the direction of a crankshaft is covered by a case cover, comprising:

a spacer interposed between the crankcase and the case cover, the spacer being formed with a lubrication system, the spacer being provided with an oil filter mounting surface which is flush with a first mating surface with respect to the crankcase, and a part of the crankcase to which the oil filter mounting surface of the spacer faces is formed with a recess opening on top, wherein the oil filter is mounted on the oil filter mounting surface and extends into the recess of the crankcase.

12. The oil filter mounting structure in an internal combustion engine according to claim 11, wherein the spacer includes:

an oil pump assembled thereto, a filter introducing channel which communicates with a pump discharge port of the oil pump and an oil introducing port on the oil filter mounting surface and is defined by opposed channel walls and a bottom wall which is formed at least into a receding part in cross section, and a filter deriving channel which communicates with an oil deriving port and an oil supply port on the oil filter mounting surface and is defined by opposed channel walls and a bottom wall which is formed at least into the receding part in cross section.

13. The oil filter mounting structure in an internal combustion engine according to claim 12, wherein an opening end surface of the opposed channel walls of the spacer is flush with a second mating surface with respect to the case cover, and a partitioning plate is brought into abutment with the opening end surface of the opposed channel walls to form the filter introducing channel and the filter deriving channel.

14. The oil filter mounting structure in an internal combustion engine according to claim 13, wherein an oil tank chamber is formed between the side wall of the spacer which is closer to the first mating surface with respect to the crankcase and the case cover, the spacer is formed with a pump body of the oil pump in cooperation with the channel walls, and a pump intake channel formed on the pump body has a pump intake port opening at the lower portion of the oil tank chamber.

15. The oil filter mounting structure in an internal combustion engine according to claim 13, wherein the partitioning plate is L-shaped and is formed of aluminum.

16. The oil filter mounting structure in an internal combustion engine according to claim 13, wherein the oil pump includes a scavenger pump body and a feed pump body which are disposed on opposite sides of a pump unit partitioning plate.

17. The oil filter mounting structure in an internal combustion engine according to claim 16, wherein the pump unit partitioning plate is flush with the first mating surface of the spacer.

18. The oil filter mounting structure in an internal combustion engine according to claim 12, the filter introducing channel and the filter deriving channel are L-shaped.

19. The oil filter mounting structure in an internal combustion engine according to claim 11, further comprising an oil pump provided on the spacer, wherein an oil pump drive shaft of the oil pump is arranged coaxially with a balancer shaft.

20. The oil filter mounting structure in an internal combustion engine according to claim 11, wherein the recess in which the oil filter is disposed is formed in an upper portion of the crankcase.

* * * * *